US006029905A

United States Patent [19]

van der Steur

[11] Patent Number: 6,029,905

[45] Date of Patent: Feb. 29, 2000

[54] ROTARY ATOMIZER WITH INTERNAL CHAMBER

[75] Inventor: Gunnar van der Steur, 420 S. Stokes St., Havre de Grace, Md. 21078

[73] Assignee: Gunnar van der Steur, Havre de Grace, Md.

[21] Appl. No.: 09/035,751

[22] Filed: Mar. 6, 1998

Related U.S. Application Data

[62] Division of application No. 08/638,138, Apr. 26, 1996.

[51] Int. Cl.[7] ..... B05B 3/10

[52] U.S. Cl. ..... 239/222.11; 239/224

[58] Field of Search ..... 239/222.11, 223, 239/224

[56] References Cited

U.S. PATENT DOCUMENTS

| | | | |
|---|---|---|---|
| 1,869,384 | 8/1932 | MacLachlan | 239/224 |
| 1,962,781 | 6/1934 | MacLachlan | 239/224 |
| 4,405,086 | 9/1983 | Vetter | 239/224 |
| 4,642,357 | 2/1987 | Culbertson et al. | 239/223 X |
| 4,776,520 | 10/1988 | Merritt | 239/223 X |
| 4,838,487 | 6/1989 | Schneider | 239/224 X |
| 4,919,333 | 4/1990 | Weinstein | 239/703 X |
| 4,943,005 | 7/1990 | Weinstein | 239/223 |
| 5,078,321 | 1/1992 | Davis et al. | 239/224 |

FOREIGN PATENT DOCUMENTS 922212 6/1947 France .

*Primary Examiner*—Lesley D. Morris
*Attorney, Agent, or Firm*—Foley & Lardner

[57] ABSTRACT

A rotary atomizer has an internal chamber for mixing of coating material. The chamber may contain ridges and grooves, as well as a series of shearing posts to mix the coating material flowing therethrough. As a result of centrifugal forces due to the spinning of the atomizer, the chamber is maintained at a negative pressure, which prevents air from being pumped into the coating material. The coating material enters the chamber through an entry passage and is forced toward the outer edge of the chamber over radiating grooves and ridges, which mix and shear the coating material while guiding the coating material toward rows of shearing posts. The shearing posts further shear and condition the coating material. The series of mixing and shearing of the coating material results in a well-mixed coating material at improved viscosity for proper atomization. The coating material then passes through a series of outlet holes, which again mix and shear the coating material subsequently guided to an outer rim of the atomizer for atomization of the intended object. As a result of the shearing and mixing, the object obtains a much improved appearance in terms of smoothness, gloss, and texture.

8 Claims, 6 Drawing Sheets

ROTARY ATOMIZER WITH INTERNAL CHAMBER

This is a divisional of application SN. 08/638,138 filed Apr. 26, 1996.

BACKGROUND OF THE INVENTION

The invention relates to atomizers, and in particular rotary atomizers, which are used to apply a coating material to an article. For example, a rotary atomizer can be used to apply a coating of paint to an automobile.

Rotary atomizers are conventionally in the shape of a bell cup, which spins at high speed, utilizing centrifugal force to propel a coating material toward and past its edge. As the coating material passes the edge of the bell cup, it is atomized into mist-like particles, which subsequently adhere to the surface of an article. To facilitate the transfer of coating material to the article, the coating material can be charged with an electric potential, while the article is grounded. The atomized coating material is then electrostatically drawn to the article.

An optimal finish on the coated product depends on many factors. To achieve a glossy and smooth appearance, it is desirable to have the coating material fully mixed and at an optimal viscosity prior to atomization. Mixing of the coating material is especially important when the coating material comprises multiple components.

SUMMARY OF THE INVENTION

It is an object of the invention to provide a rotary atomizer that has improved mixing capabilities to provide coating material that is optimally mixed to provide an improved finish in terms of smoothness, gloss and texture.

A rotary atomizer according to the invention includes an internal chamber, a liquid entry passage for communicating coating liquid to the internal chamber, and a plurality of outlet holes distributing liquid from the internal chamber. The liquid entry passage can be, for example, positioned along a central axis of the rotary atomizer. The plurality of outlet holes can connect an outer edge of the internal chamber with an outer portion of an atomizer face proximate to an outer rim of the atomizer.

In one example, each of the plurality of outlet holes can be positioned a substantially same distance from the central axis of the rotary atomizer so that the plurality of outlet holes collectively form a substantially circular liquid distribution portion on the outer portion of the atomizer face. Further, each of the plurality of outlet holes can be at an angle offset from the central axis so that the liquid distribution portion is at a different distance from the central axis than the edge of the internal chamber, for example, a greater distance from the central axis than the edge of the internal chamber.

The internal chamber can include, for example, the center region, an outer edge, and a plurality of grooves communicatively connecting the center region with the outer edge. The internal chamber can further include a plurality of shearing posts positioned between the center region and the outer edge. In one example, the shearing posts are interleaved between the grooves. Further, the number of shearing posts can be equal to, greater than, or less than the number of the grooves.

The internal chamber can be formed by a cavity in an outer member and an insert positioned in the cavity. At least some of the grooves can be cut into the cavity of the outer member. Further, at least some of the grooves can be cut into the insert. Similarly, at least some of the shearing posts can extend from the cavity. Further, at least some of the shearing posts can extend from the insert.

A rotary atomizer according to the invention can further include a deflecting plate positioned in an upper portion of the internal chamber along the central axis of the rotary atomizer. A plurality of through-holes can be provided in the deflecting plate, and a deflecting member can be axially displaced from the deflecting plate with at least a portion of the deflecting member positioned between the through-holes and the face of the rotary atomizer. Further, an opening in a central portion of the face of the rotary atomizer can be provided.

Also provided is a method of manufacturing a rotary atomizer which, includes the steps of forming an internal chamber in the rotary atomizer, forming a liquid entry passage communicatively connected to the internal chamber, and forming a plurality of outlet holes between the internal chamber and a face of the rotary atomizer. This method can further include the step of forming a plurality of grooves in the internal chamber. This method can also further include the step of forming a plurality of shearing posts in the internal chamber. The step of forming the internal chamber can include the steps of forming a cavity in an outer member, forming an insert, and positioning the insert in the cavity such that the internal chamber is formed between the cavity and the insert.

Also provided is a method of transporting coating material, including the steps of introducing a coating material to an internal chamber of a rotary atomizer by way of an entry passage, rotating the rotary atomizer to cause the coating material to flow toward an edge of the internal chamber, and flowing the coating material to a face of the rotary atomizer through a plurality of outlet holes positioned between the edge of the internal chamber and the face of the rotary atomizer. This method can further include the step of mixing the coating material in the internal chamber through contact with a plurality of grooves and shearing posts. This method can further include the steps of flowing the coating material to an outer rim of the rotary atomizer and atomizing the coating material. This method can further include the step of electrically charging the coating material, and can also further include the step of coating an object with the atomized coating material.

BRIEF DESCRIPTION OF THE DRAWINGS

The above described embodiments of the invention will be fully appreciated upon a review of the detailed description and the figures, wherein.

DETAILED DESCRIPTION

Figure 1:
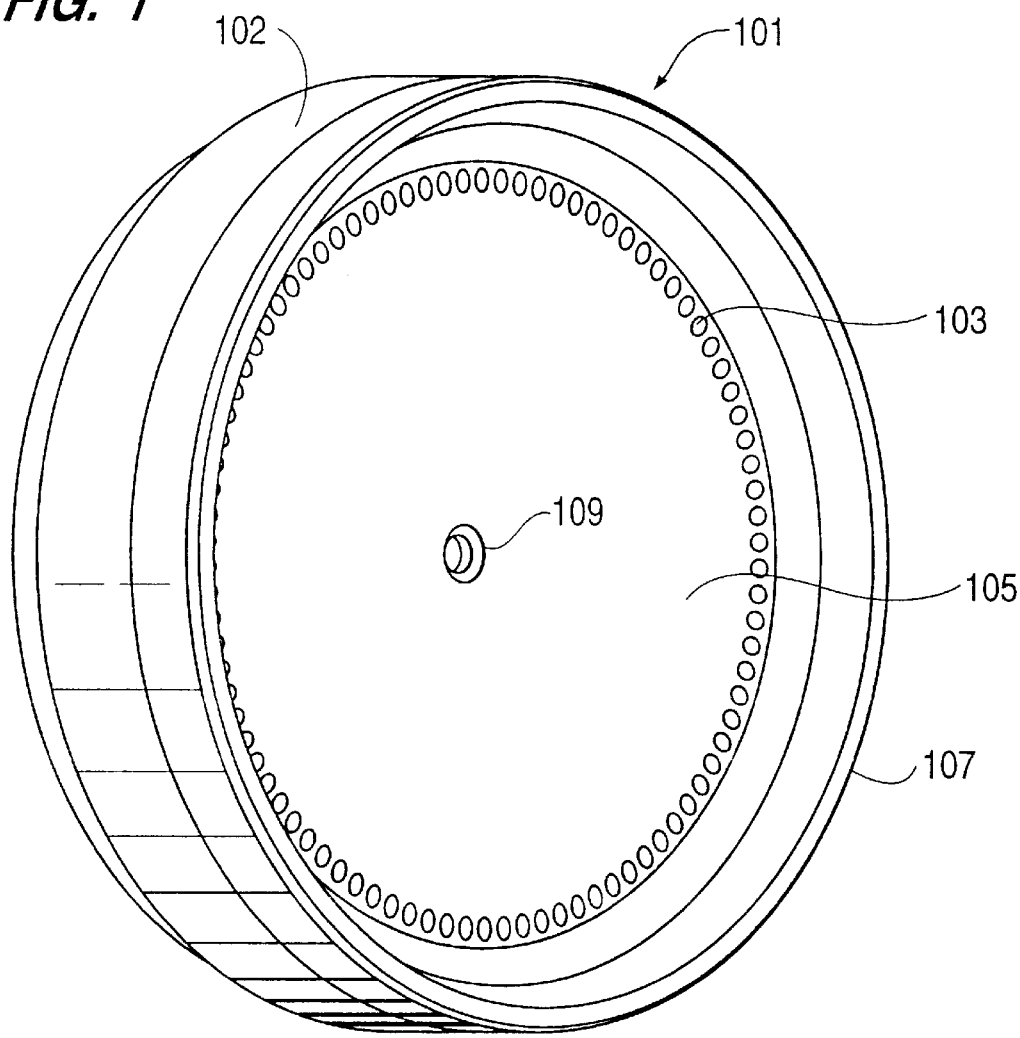
FIG. 1 shows an example of a rotary atomizer according to the invention.
Figure 2:
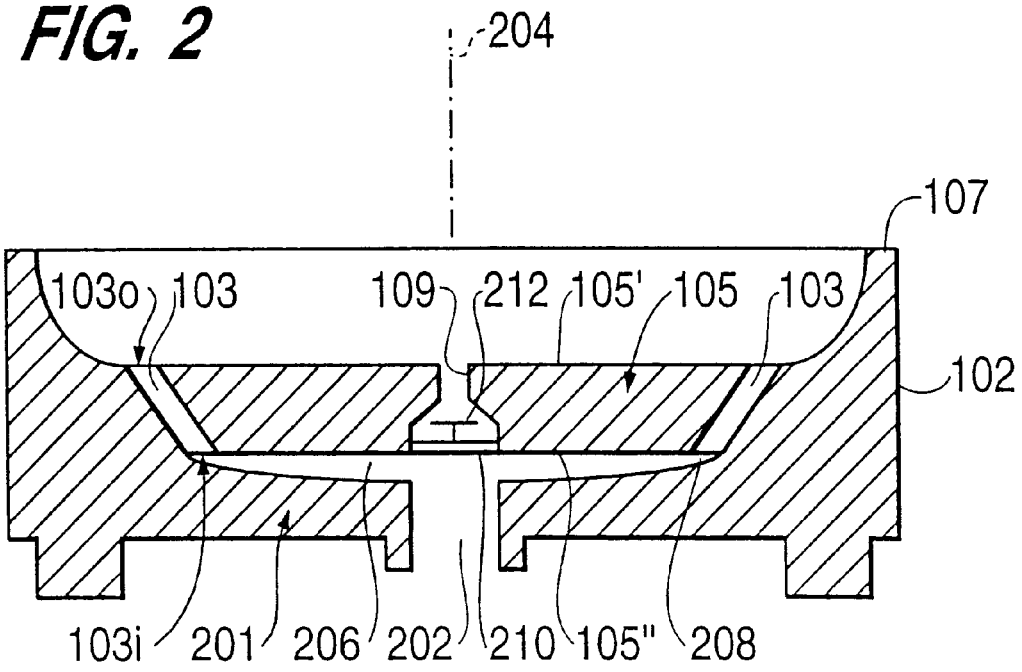
FIG. 2 shows a cross-section of an example of an atomizer of FIG. 1.

FIGS. 1 and 2 show a rotary atomizer 101 for spraying a coating material, such as a liquid coating material, to apply the coating material to a product. Referring to FIGS. 1 and 2, the atomizer 101 has a substantially cylindrical body 102 having an outer rim 107, an atomizer face wall 105 spaced axially from the outer rim, and a rear wall 201 spaced from the face wall 105. As shown in FIG. 2, the face wall 105 joins the rear wall 201 at the outer edge of the face wall 105. The spacing between the face and rear walls forms a cavity or space, which defines an internal chamber 206. A plurality of outlet holes 103 are formed in an outer portion of the face wall 105. The face wall 105 defines a front side or face 105' facing the outerside of the rotary atomizer and a rear side or face 105" facing the internal chamber 206. The outlet holes 103 each have an outlet 103*o* on the front face 105' and an inlet 103*i* on the rear side 105". Each of the outlet holes 103 is at an angle offset from the central axis 204 of the rotary atomizer. Coating material flows through the outlet holes 103 while the atomizer 101 rotates. The coating material, due to the centrifugal force of the rotating atomizer 101, flows toward an outer rim 107. As the coating material flows past the outer rim 107, atomization takes place for application of the coating material to an intended object.

The atomizer 101 also contains a circular opening 109 at its center. The circular opening 109 can be used for cleaning purposes to flow cleaning material onto the face of the atomizer 101 during a cleaning operation, for example, when the atomizer 101 is not rotating or when the atomizer 101 is rotating at a reduced speed. Further, the opening 109 can be used to allow a small percentage of the coating material to flow therethrough during the atomization process to clean the face 105 and prevent atomized coating material from adhering thereto.

FIG. 2 shows a cross-section of the internal structure of one example of the atomizer 101. As shown, a liquid entry passage 202 is aligned along a central axis 204. The liquid passage 202 is formed centrally through the rear wall 201. Coating material flows through the entry passage 202 into the internal chamber 206. Centrifugal forces resulting from rotation cause the coating material to flow within the internal chamber 206 to its outer edge 208 and into its outlet holes 103. The coating material subsequently flows through the outlet holes 103 onto face 105 near the outer portion thereof, and then toward the outer rim 107 to complete the atomization process.

The outlet holes 103 are shown, in this example, as having an angle offset away from the central axis 204 such that the portion (outlet 103) of the outlet hole 103 appearing on the face 105 is further from the central axis 204 than the portion (inlet 103*i*) proximate to the outer edge 208 of the internal chamber 206. This arrangement has been found to facilitate the flow of coating material through the outlet holes 103. If alternative flow characteristics are desired, the outlet holes 103 can alternatively be aligned with the central axis 204 or can be inclined toward the central axis 204.

Figure 3:
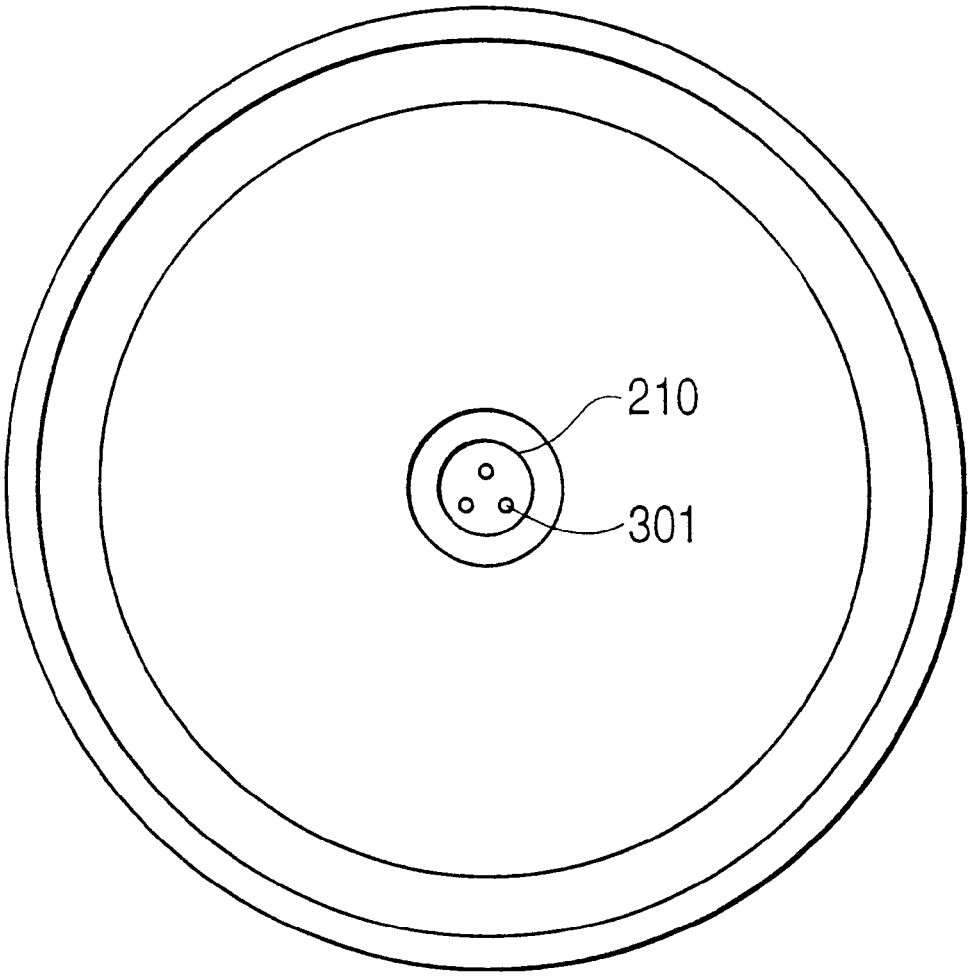
FIG. 3 shows a rear view of an example of an atomizer of FIG. 1.

FIG. 2 also shows and deflecting plate 210 and a deflecting member 212. As shown in FIG. 3, which is a rear view of the atomizer shown in FIG. 2, the deflecting plate 210 contains through-holes 301. Thus, coating material or cleaning material can pass through the through-holes 301 of the deflecting plate 210 and deflect off of the deflecting member 212 for passage out of the annular opening 109.

Figure 4:
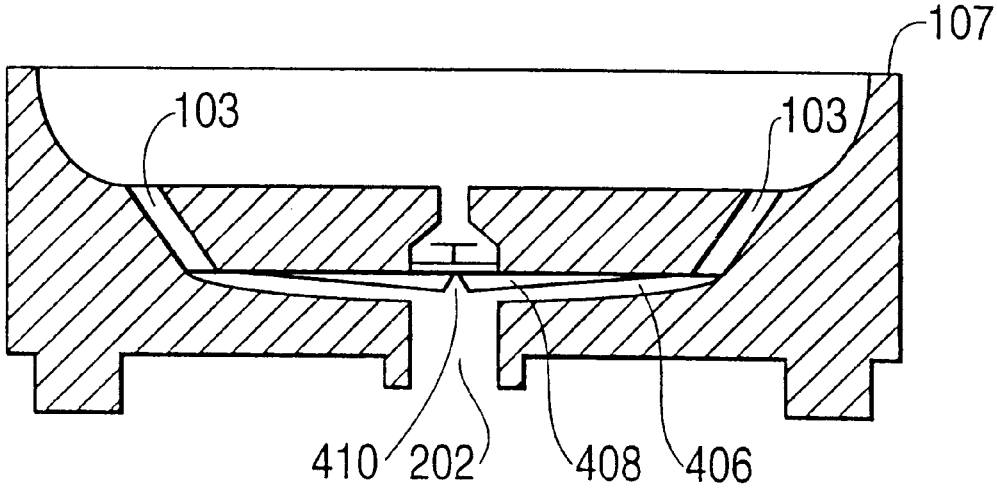
FIG. 4 shows a cross section of an alternative example of an atomizer of FIG. 1.

FIG. 4 shows an embodiment of the atomizer 101 that is substantially similar to the embodiment of FIGS. 1 and 2. The atomizer 101 according to FIG. 4 contains an internal chamber 406 having a plurality of ridges 408 forming grooves 410 therebetween. As coating material flows through the entry passage 202 toward the outlet holes 103, the coating material is mixed by the ridges 408 and flows through the grooves 410 toward the outlet holes 103. The mixing of the coating material can be particularly advantageous in cases where the coating material is made from a plurality of components. As mentioned earlier, the coating material then flows out of the outlet holes 103 toward the outer rim 107 to complete the atomization process.

Figure 5:
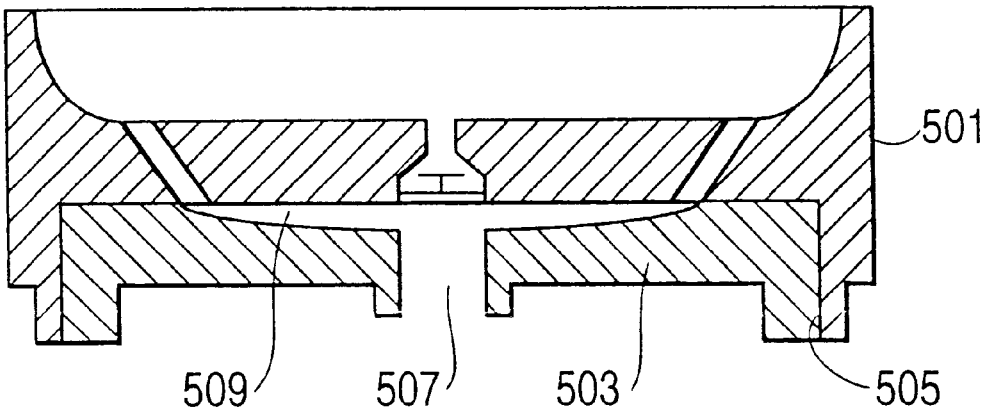
FIG. 5 shows a cross section of another alternative of an atomizer of FIG. 1.

FIG. 5 shows an example of the rotary atomizer 101 made from two components, an outer member 501 and an insert 503, inserted into, cavity 505 of the outer member 501. As shown in this example, a liquid entry passage 507 is made from a circular central opening in the insert 503. Further, internal chamber 509 is defined as an area existing between the outer member 501 and the insert 503.

Figure 6:
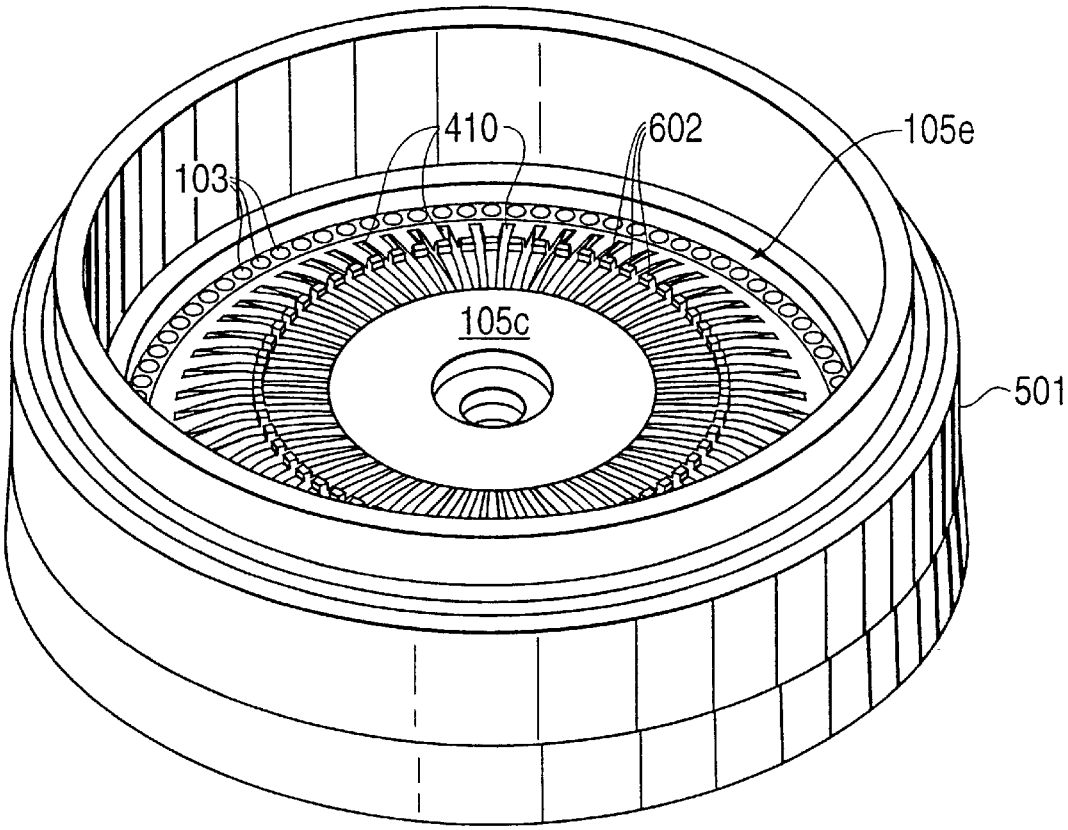
FIG. 6 shows a rear view of an outer member of a multi-component atomizer of FIG. 5, wherein the outer member contains grooves and shearing posts.

FIG. 6 shows a rear view of the outer member 501 in an embodiment containing grooves 410 such as those shown in FIG. 4. This embodiment also shows shearing posts 602 positioned between the grooves 410 on the ridges 408 which define the grooves 410. As outer member 501 is mated with an insert, forming an internal chamber therebetween, the coating material flows toward the outlet holes 103 by way of the grooves 410, and is mixed by the grooves 410 and the shearing posts 602.

In this example, the grooves and sheering posts are formed in the cavity of the outer member between a center region 105*c* and an outer edge 105*e* (where the outlet holes 103 are formed) of the face wall 105. Additional grooves and sheering posts can be formed on the insert, such that these additional grooves and sheering posts are in a facing relationship with the grooves and sheering posts formed in the cavity. Various combinations of grooves and sheering posts in the cavity portion of the internal chamber and in the insert portion of the internal chamber are possible, depending on the desired degree of sheering and mixing.

For example, the present example shows a single row of sheering posts, equally spaced from the central axis 204, and each centrally positioned on a corresponding ridge. Alternatively, multiple rows of sheering posts can be employed. In another alternative, sheering posts can be spaced at varying distances from the central axis 204. Also, although the present example shows each sheering post centrally spaced on a corresponding ridge, each sheering post can be placed anywhere within a groove or upon a ridge.

A rotary atomizer configured according to the invention thus provides for increased mixing of a coating material within an internal chamber of the atomizer during the process of atomizing the coating material.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

What is claimed is:

1. A rotary atomizer comprising:

a rotatable body having a face wall with a central opening and a rear wall spaced from the face wall, the space therebetween defining an internal chamber;

a liquid entry passage positioned along a central axis of the rear wall for communicating liquid to the internal chamber;

a plurality of outlet holes formed through the face wall for distributing the liquid from the internal chamber;

a deflecting plate positioned in the central opening of the face wall, the deflecting plate having a plurality of through-holes; and a deflecting member positioned within the central opening and axially spaced from and connected to the deflecting plate, wherein the central opening has an upstream portion and a downstream portion, the downstream portion having a smaller opening dimension than the upstream portion, wherein the deflecting plate and the deflecting member are positioned away from the upstream portion of the central opening, and wherein the deflecting plate through-holes direct liquid to the deflecting member so that the deflecting member deflects the liquid before the liquid exits the central opening.

2. A rotary atomizer according to claim 1, wherein the outlet holes are formed proximate the outer edge of the internal chamber, which is proximate to an outer region of the face wall.

3. A rotary atomizer according to claim 2, wherein each of the outlet holes is positioned at a substantially same distance from a central axis of the rotary atomizer, collectively forming a substantially circular liquid distribution portion around the face wall.

4. A rotary atomizer according to claim 3, wherein the face wall has a front side and a rear side, each of the outlet holes has an outlet on the front side and an inlet on the rear side, wherein each of the outlet holes is at an angle offset from the central axis, the outlet being at a first distance from the central axis, and the inlet being at a second distance from the central axis.

5. A rotary atomizer according to claim 4, wherein the first distance is greater than the second distance.

6. A rotary atomizer according to claim 1, wherein the deflecting plate is positioned within the facing wall and upstream of the deflecting member.

7. A rotary atomizer according to claim 1, wherein the deflection plate is larger than the deflection member.

8. A rotary atomizer according to claim 7, wherein the central opening has a middle portion joining the upstream and downstream portions, the middle portion being narrower adjacent to the upstream portion and wider adjacent to the downstream portion.

* * * * *